US010814468B2

(12) United States Patent
Krug et al.

(10) Patent No.: US 10,814,468 B2
(45) Date of Patent: Oct. 27, 2020

(54) PERCUSSION TOOL

(71) Applicant: MILWAUKEE ELECTRIC TOOL CORPORATION, Brookfield, WI (US)

(72) Inventors: Alexander Krug, Leutenbach (DE); Zbyněk Kadlec, Přeštice (CZ); Günter Karg, Winnenden (DE); Andrew Delmar Van Hoorn, Menomonee Falls, WI (US); Kevin Gee, Milwaukee, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 0 days.

(21) Appl. No.: 16/164,000

(22) Filed: Oct. 18, 2018

(65) Prior Publication Data

US 2019/0118364 A1 Apr. 25, 2019

Related U.S. Application Data

(60) Provisional application No. 62/650,745, filed on Mar. 30, 2018, provisional application No. 62/574,838, filed on Oct. 20, 2017.

(51) Int. Cl.
*B25D 17/08* (2006.01)
*B25D 17/24* (2006.01)
(Continued)

(52) U.S. Cl.
CPC ..... *B25D 17/082* (2013.01); *B25D 11/04* (2013.01); *B25D 11/068* (2013.01);
(Continued)

(58) Field of Classification Search
CPC .... B25D 17/08; B25D 17/088; B25D 17/082; B25D 11/04; B25D 11/066; B25D 17/02;
(Continued)

(56) References Cited

U.S. PATENT DOCUMENTS 2,270,840 A * 1/1942 Allen ..... B25D 17/08 279/19.5
3,028,840 A 4/1962 Leavell
(Continued)

FOREIGN PATENT DOCUMENTS

DE 2219320 B1 10/1973
EP 0033304 A1 8/1981
(Continued)

OTHER PUBLICATIONS

Milwaukee Tool, K2500H Fact Sheet, 2017, 3 pages.
(Continued)

*Primary Examiner* — Sunil K Singh
*Assistant Examiner* — Paul M Janeski
(74) *Attorney, Agent, or Firm* — Michael Best & Friedrich LLP

(57) ABSTRACT

A percussion tool is used for performing a chiseling operation on a workpiece with a chisel. The percussion tool comprises a housing including a cylinder portion, a tool holder coupled to the cylinder portion for holding the chisel, and a percussion mechanism including a striker supported for reciprocation in the cylinder portion. The percussion mechanism is configured to impart repeated axial impacts to the chisel with the striker. The percussion tool further comprises a flange between the cylinder portion and the tool holder. Movement of the chisel within the tool holder toward the percussion mechanism is stopped by the flange.

12 Claims, 7 Drawing Sheets

(51) Int. Cl.

| | |
|---|---|
| ***B25D 11/12*** | (2006.01) |
| ***B25D 11/04*** | (2006.01) |
| ***B25D 11/06*** | (2006.01) |
| ***B25D 17/02*** | (2006.01) |
| ***B25D 17/04*** | (2006.01) |

(52) U.S. Cl.
CPC ..... *B25D 11/125* (2013.01); *B25D 17/02* (2013.01); *B25D 17/04* (2013.01); *B25D 17/24* (2013.01); *B25D 2250/095* (2013.01); *B25D 2250/385* (2013.01)

(58) Field of Classification Search
CPC ..... B25D 17/04; B25D 2250/095; B25D 2250/385; B25D 11/125; B25D 17/24; B23B 31/174
See application file for complete search history.

(56) References Cited

U.S. PATENT DOCUMENTS 3,028,841 A 4/1962 Leavell
3,335,805 A 8/1967 Diez et al.
3,559,751 A 2/1971 Yamada
3,568,780 A 3/1971 Matsuo
3,570,608 A 3/1971 Erma
3,727,700 A 4/1973 Amtsberg
3,735,823 A 5/1973 Terada
3,822,001 A 7/1974 Sides
3,824,417 A 7/1974 Moores, Jr.
3,835,935 A 9/1974 Sides et al.
3,881,554 A 5/1975 Cooley et al.
3,995,703 A 12/1976 Wanner
4,030,553 A 6/1977 Rockwell
4,168,751 A 9/1979 Deike
4,282,938 A 8/1981 Minamidate
4,290,489 A 9/1981 Leavell
4,305,473 A 12/1981 Gidlund
4,310,055 A 1/1982 Wanner et al.
4,332,300 A 6/1982 Scarton et al.
4,476,941 A 10/1984 Buck et al.
4,478,293 A 10/1984 Weilenmann et al.
4,489,261 A 12/1984 Hartwig et al.
4,582,144 A 4/1986 Mizutani
4,614,241 A * 9/1986 Crover ..... B25D 17/24 173/133
4,705,934 A 11/1987 Winkler
4,747,455 A 5/1988 Cunningham
4,828,046 A 5/1989 Pyatov
4,991,664 A 2/1991 Kolgan et al.
5,099,926 A 3/1992 Fushiya et al.
5,117,923 A 6/1992 Wuhrer
5,161,623 A 11/1992 Erlach
5,205,363 A 4/1993 Pascale
5,458,205 A 10/1995 Wijk
5,586,607 A 12/1996 Neumaier et al.
5,647,525 A 7/1997 Ishizawa
5,775,201 A 7/1998 Tanji et al.
5,971,083 A 10/1999 Wiklund
5,971,403 A 10/1999 Yahagi et al.
5,996,708 A 12/1999 Gerold
6,116,352 A 9/2000 Frauhammer et al.
6,119,796 A 9/2000 Schmid
6,152,245 A 11/2000 Nilsson
6,155,356 A 12/2000 Kikuchi et al.
6,237,700 B1 5/2001 Berger et al.
6,325,157 B1 12/2001 Arakawa et al.
6,513,604 B2 2/2003 Hanke
6,520,266 B2 2/2003 Bongers-Ambrosius et al.
6,520,269 B2 2/2003 Geiger et al.
6,523,622 B1 2/2003 Berger et al.
6,568,484 B1 5/2003 Schmid et al.
6,575,254 B2 6/2003 Bongers-Ambrosius et al.
6,621,241 B2 9/2003 Reid et al.
6,729,412 B2 5/2004 Shinohara
6,732,815 B2 5/2004 Hanke et al.
6,745,850 B2 6/2004 Hahn
6,763,897 B2 7/2004 Hanke et al.
6,776,245 B2 8/2004 Kristen et al.
6,799,643 B2 10/2004 Voulkidis et al.
6,799,644 B2 10/2004 Hoop et al.
6,805,206 B2 10/2004 Hanke
6,808,026 B2 10/2004 Berger et al.
6,854,530 B1 2/2005 Yiu
6,866,105 B2 3/2005 Pfisterer et al.
6,868,918 B2 3/2005 Shinohara
6,877,569 B2 4/2005 Koskimaki
6,902,012 B2 6/2005 Kristen et al.
6,907,942 B2 6/2005 Kikuchi et al.
6,907,943 B2 6/2005 Ikuta
6,938,704 B2 9/2005 Berger et al.
6,938,705 B2 9/2005 Kikuchi
6,948,570 B2 9/2005 Kristen et al.
6,948,571 B2 9/2005 Hanke et al.
6,962,211 B2 11/2005 Daubner et al.
6,978,847 B2 12/2005 Buchholz
6,981,625 B2 1/2006 Schad
7,011,156 B2 3/2006 von Gynz-Rekowski
7,013,984 B2 3/2006 Atkinson et al.
7,021,401 B2 4/2006 Droste et al.
7,025,183 B2 4/2006 Steffan et al.
7,036,703 B2 5/2006 Grazioli et al.
7,040,413 B2 5/2006 Mueller et al.
7,048,076 B2 5/2006 Cecchin et al.
7,077,217 B2 7/2006 Buchholz
7,096,973 B2 8/2006 Ikuta et al.
7,121,360 B2 10/2006 Fünfer
7,124,840 B2 10/2006 Miyakawa
7,143,842 B2 12/2006 Ikuta
7,204,322 B2 4/2007 Sakai
7,252,157 B2 8/2007 Aoki
7,258,173 B2 8/2007 Hammerstingl et al.
7,284,622 B2 10/2007 Hahn
7,320,368 B2 1/2008 Watanabe
7,331,407 B2 2/2008 Stirm et al.
7,334,648 B2 2/2008 Arimura
7,383,895 B2 6/2008 Aoki
7,401,661 B2 7/2008 Berghauser et al.
7,413,026 B2 8/2008 Berghauser et al.
7,445,054 B2 11/2008 Heep et al.
7,445,056 B2 11/2008 Stirm et al.
7,451,833 B2 11/2008 Hahn
7,469,752 B2 12/2008 Furusawa et al.
7,500,527 B2 3/2009 Fischer et al.
7,513,317 B2 4/2009 Satou
7,516,801 B2 4/2009 Meixner et al.
7,523,791 B2 4/2009 Aoki
7,533,736 B2 5/2009 Stirm et al.
7,562,721 B2 7/2009 Stirm et al.
7,588,097 B2 9/2009 Kamegai et al.
7,604,071 B2 10/2009 Ikuta
D603,674 S 11/2009 Werner
7,624,815 B2 12/2009 Friedrich et al.
7,637,328 B2 12/2009 Sato
7,640,997 B2 1/2010 Bram et al.
7,654,338 B2 2/2010 Hefting et al.
7,677,327 B2 3/2010 Meixner et al.
7,712,547 B2 5/2010 Ikuta et al.
7,726,413 B2 6/2010 Berghauser et al.
7,766,096 B2 8/2010 Satou et al.
7,784,562 B2 8/2010 Ikuta
7,802,711 B2 9/2010 Fuenfer
7,806,201 B2 10/2010 Aoki
7,814,986 B2 10/2010 Berghauser et al.
7,819,203 B2 10/2010 Sato et al.
7,832,498 B2 11/2010 Sugiyama et al.
7,861,799 B2 1/2011 Lwakami et al.
7,878,264 B2 2/2011 Koch et al.
7,882,899 B2 2/2011 Borinato et al.
7,882,900 B2 2/2011 Borinato et al.
7,921,934 B2 4/2011 Aoki
7,926,584 B2 4/2011 John et al.
7,938,196 B2 5/2011 Fischer et al.
7,967,078 B2 6/2011 Aoki

(56) References Cited

U.S. PATENT DOCUMENTS 7,987,921 B2 8/2011 Hahn
8,011,443 B2 9/2011 Meixner et al.
8,016,047 B2 9/2011 Ookubo et al.
8,074,734 B2 12/2011 Gumpert et al.
8,087,472 B2 1/2012 Usselman et al.
8,091,651 B2 1/2012 Kuhnle et al.
8,096,369 B2 1/2012 Meixner
8,127,862 B2 3/2012 Aoki
8,176,997 B2 5/2012 Ohlendorf
8,181,715 B2 5/2012 Bito et al.
8,196,674 B2 6/2012 Ikuta et al.
8,235,138 B2 8/2012 Aoki
8,245,791 B2 8/2012 Kriedel et al.
D666,468 S 9/2012 Braun
8,261,851 B2 9/2012 Ikuta et al.
8,261,854 B2 9/2012 Kikiuchi et al.
8,267,191 B2 9/2012 Furusawa et al.
8,292,002 B2 10/2012 Baumann et al.
8,302,701 B2 11/2012 Morimura et al.
8,333,251 B2 12/2012 Cecchin et al.
8,342,260 B2 1/2013 Buchenau et al.
8,347,981 B2 1/2013 Aoki
8,360,168 B2 1/2013 Kikiuchi et al.
8,413,742 B2 4/2013 Ikuta et al.
8,485,274 B2 7/2013 Ikuta et al.
8,505,647 B2 8/2013 Kasuya et al.
8,534,376 B2 9/2013 Braun et al.
8,561,716 B2 10/2013 Aoki
8,590,633 B2 11/2013 Berghauser et al.
8,613,328 B2 12/2013 Meixner et al.
8,616,301 B2 12/2013 John et al.
8,668,026 B2 3/2014 Aoki
8,678,106 B2 3/2014 Matsunaga et al.
8,695,723 B2 4/2014 Werner et al.
8,695,724 B2 4/2014 Nakashima
8,844,647 B2 9/2014 Kamegai et al.
8,955,615 B2 2/2015 John et al.
8,960,323 B2 2/2015 Oberheim
8,985,236 B2 3/2015 Wierer et al.
9,044,848 B2 6/2015 Iio
9,067,312 B2 * 6/2015 Koch ..... B25D 17/082
9,085,075 B2 7/2015 Ikuta
9,126,320 B2 9/2015 Shinma et al.
9,132,541 B2 9/2015 John et al.
9,156,152 B2 10/2015 Machida
9,259,830 B2 2/2016 Schad et al.
9,296,095 B2 3/2016 Yoshino et al.
9,314,855 B2 4/2016 Ookubo et al.
9,314,912 B2 4/2016 Binder et al.
9,321,163 B2 4/2016 Onoda et al.
9,573,254 B2 2/2017 Bartoszek
9,654,044 B2 5/2017 Miyazaki
9,808,925 B2 11/2017 Yamada et al.
9,815,160 B2 11/2017 Nitsche et al.
2001/0013683 A1 8/2001 Yahagi
2002/0053445 A1 5/2002 Kim et al.
2003/0006051 A1 1/2003 Schmitzer et al.
2003/0047887 A1 3/2003 Hahn
2003/0116333 A1 6/2003 Voulkidis et al.
2003/0155142 A1 8/2003 Kikuchi et al.
2004/0000414 A1 1/2004 Echtler et al.
2004/0065454 A1 4/2004 Berger et al.
2004/0065455 A1 4/2004 Berger et al.
2004/0144551 A1 7/2004 Koskimaki
2004/0163830 A1 8/2004 Shinohara
2004/0194986 A1 10/2004 Ikuta
2005/0034881 A1 2/2005 Berger et al.
2005/0045352 A1 3/2005 Yiu
2005/0072584 A1 4/2005 Dresig et al.
2005/0082073 A1 4/2005 Funfer
2005/0145403 A1 7/2005 Kikuchi
2005/0205273 A1 9/2005 Yiu et al.
2005/0230130 A1 10/2005 Strasser et al.
2005/0274534 A1 12/2005 Goetzfried et al.
2006/0000627 A1 1/2006 Frauhammer et al.
2006/0006749 A1 1/2006 Sasaki et al.
2006/0041241 A1 2/2006 Herndon
2006/0060366 A1 3/2006 Bodine et al.
2006/0065417 A1 3/2006 Funfer et al.
2006/0131042 A1 6/2006 Hammerstingl et al.
2006/0185868 A1 8/2006 Becht
2006/0237206 A1 10/2006 Schamberger et al.
2006/0260830 A1 11/2006 Dresig
2007/0107920 A1 5/2007 Keller
2007/0261871 A1 11/2007 Ohlendorf
2007/0277992 A1 12/2007 Fuenfer
2008/0006419 A1 1/2008 Harcar et al.
2008/0006420 A1 1/2008 Berghauser et al.
2008/0006422 A1 1/2008 Berghauser et al.
2008/0006423 A1 1/2008 Berghauser et al.
2008/0149359 A1 6/2008 Meixner
2008/0196912 A1 8/2008 Gass et al.
2008/0203995 A1 8/2008 Carrier et al.
2008/0236855 A1 10/2008 Meixner et al.
2008/0245220 A1 10/2008 Duesselberg et al.
2008/0264660 A1 10/2008 Berghauser et al.
2008/0283260 A1 11/2008 Kramer
2009/0120770 A1 5/2009 Hammerstingl et al.
2009/0195204 A1 8/2009 Gumpert
2009/0275273 A1 11/2009 Purohit et al.
2010/0012337 A1 1/2010 Meixner
2010/0019690 A1 1/2010 Libohova et al.
2010/0163260 A1 7/2010 Berger et al.
2010/0175903 A1 7/2010 Ikuta et al.
2010/0263894 A1 10/2010 Kristen et al.
2010/0300718 A1 12/2010 Hartmann et al.
2011/0024144 A1 2/2011 Usselman et al.
2011/0073339 A1 3/2011 Werner et al.
2011/0108301 A1 5/2011 Erhardt et al.
2011/0171887 A1 7/2011 Tanimoto et al.
2011/0303429 A1 12/2011 Kohlschmied et al.
2011/0303430 A1 12/2011 Hartmann et al.
2011/0303431 A1 12/2011 Hartmann et al.
2012/0038119 A1 2/2012 Koch et al.
2012/0045976 A1 2/2012 Roser et al.
2012/0118597 A1 5/2012 Hauptmann et al.
2012/0186842 A1 7/2012 Wiedemann et al.
2012/0227995 A1 9/2012 Diem et al.
2012/0279741 A1 11/2012 Schlesak et al.
2013/0025895 A1 1/2013 Friedrich
2013/0118766 A1 5/2013 Watanabe
2013/0133911 A1 5/2013 Ishikawa et al.
2013/0186661 A1 7/2013 Okubo et al.
2013/0201679 A1 8/2013 Pickard et al.
2013/0250567 A1 9/2013 Edmond et al.
2013/0250579 A1 9/2013 Athalye
2013/0265750 A1 10/2013 Pickard et al.
2013/0277080 A1 10/2013 Hartmann et al.
2013/0333904 A1 12/2013 Raggl et al.
2013/0333905 A1 12/2013 Binder
2013/0333906 A1 12/2013 Binder
2013/0333910 A1 12/2013 Tanimoto et al.
2013/0333911 A1 12/2013 Binder et al.
2014/0008092 A1 1/2014 Yanagihara
2014/0131059 A1 5/2014 Verbrugge et al.
2014/0290971 A1 10/2014 Kaindlbauer
2014/0374130 A1 12/2014 Nakamura et al.
2015/0151419 A1 6/2015 Bralla
2015/0231770 A1 8/2015 Kusakawa et al.
2015/0233537 A1 8/2015 Athalye et al.
2015/0252970 A1 9/2015 Athalye
2015/0266176 A1 9/2015 Takeuchi et al.
2015/0328579 A1 11/2015 Ikuta et al.
2015/0328760 A1 11/2015 Ikuta et al.
2015/0367492 A1 12/2015 Lindell
2016/0020443 A1 1/2016 White et al.
2016/0067856 A1 3/2016 Bito et al.
2016/0089757 A1 3/2016 Wirnitzer et al.
2016/0107303 A1 4/2016 Roberts
2016/0129576 A1 5/2016 Nishikawa et al.
2016/0311102 A1 10/2016 Ebner
2016/0354905 A1 12/2016 Ely et al.
2017/0057038 A1 3/2017 Coleman
2017/0057064 A1 3/2017 Ishikawa et al.

(56) References Cited

U.S. PATENT DOCUMENTS

| | | | |
|---|---|---|---|
| 2017/0151657 | A1 | 6/2017 | Nagasaka et al. |
| 2017/0173768 | A1 | 6/2017 | Dey, IV et al. |
| 2017/0246732 | A1 | 8/2017 | Dey, IV et al. |
| 2017/0246736 | A1 | 8/2017 | Kikuchi |
| 2017/0361447 | A1 | 12/2017 | Ontl et al. |

FOREIGN PATENT DOCUMENTS

| | | | |
|---|---|---|---|
| EP | 0280195 | A2 | 8/1988 |
| EP | 0421121 | B1 | 11/1993 |
| EP | 1355104 | A1 | 10/2003 |
| EP | 1584422 | B1 | 10/2008 |
| EP | 2199028 | A2 | 6/2010 |
| EP | 1637288 | B1 | 8/2014 |
| EP | 3184259 | A1 | 6/2017 |
| EP | 3184259 | A1 | 6/2017 |
| GB | 1154593 | A | 6/1969 |
| JP | 2008178935 | A | 8/2008 |
| KR | 101681612 | B1 | 12/2016 |
| WO | WO8801219 | A1 | 2/1988 |
| WO | WO2003022531 | A1 | 3/2003 |
| WO | WO2007077946 | A2 | 7/2007 |
| WO | WO2007101736 | A1 | 9/2007 |
| WO | WO2007105742 | A1 | 9/2007 |
| WO | WO2008055743 | A1 | 5/2008 |
| WO | WO2009007152 | A1 | 1/2009 |
| WO | WO2009015924 | A1 | 2/2009 |
| WO | WO2009083317 | A1 | 7/2009 |
| WO | WO2010069647 | A1 | 6/2010 |
| WO | WO2011082892 | A1 | 7/2011 |
| WO | WO2016059032 | A1 | 4/2016 |
| WO | WO2008096788 | A1 | 8/2018 |

OTHER PUBLICATIONS

Milwaukee Tool, K2500H Owner's Manual, 2017, 49 pages.
Milwaukee Tool, K2500H Product Specification, 2017, 2 pages.
International Search Report and Written Opinion for Application No. PCT/US2018/056457 dated Mar. 28, 2019, 22 pages.
International Partial Search Report and Invitation to Pay Additional Fees for Application No. PCT/US2018/056457 dated Feb. 1, 2019, 17 pages.

* cited by examiner

PERCUSSION TOOL

CROSS-REFERENCE TO RELATED APPLICATIONS

This application claims priority to U.S. Provisional Patent Application No. 62/574,838 filed on Oct. 20, 2017, the entire content of which is incorporated herein by reference. This application also claims priority to U.S. Provisional Patent Application No. 62/650,745 filed on Mar. 30, 2018, the entire content of which is incorporated herein by reference.

FIELD OF THE INVENTION

The present invention relates to percussion tools, and more particularly to tool holders for holding chisels for use with a percussion tool.

BACKGROUND OF THE INVENTION

Percussion tools can use tool holders to hold a chisel. A percussion mechanism of the percussion tool can include a striker to impart repeated axial impacts to the chisel, which in turn repeatedly impacts a workpiece or surface. The chisel can be inserted into the tool holder so as to abut the striker in order to receive the repeated axial impacts.

SUMMARY OF THE INVENTION

The present invention provides, in one aspect, a percussion tool for performing a chiseling operation on a workpiece with a chisel. The percussion tool comprises a housing, an electric motor positioned within the housing, and a percussion mechanism driven by the motor and including a striker supported for reciprocation relative to the housing along a longitudinal axis. The percussion tool further comprises a tool holder coupled to the housing and including a rotatable handle having a rod that rotates with the handle within the tool holder. The chisel is securable in and removable from the tool holder. The chisel has a longitudinal groove that is substantially parallel with the longitudinal axis. When the chisel is secured in the tool holder, the chisel is permitted to axially reciprocate within the tool holder in response to receiving repeated axial impacts from the striker. The handle is moveable between a first position, in which the rod is received in the groove and the chisel is secured in the tool holder, and a second position, in which the rod is removed from the groove and the chisel is removable from the tool holder. When the handle is in the second position, an acute angle is defined between a first reference plane defined by the handle and a second reference plane that is perpendicular to the longitudinal axis. The acute angle is 10 degrees or less.

The present invention provides, in another aspect, a percussion tool for performing a chiseling operation on a workpiece with a chisel. The percussion tool comprises a housing, an electric motor positioned within the housing, and a percussion mechanism driven by the motor and including a striker supported for reciprocation relative to the housing along a longitudinal axis. The percussion tool further comprises a tool holder coupled to the housing and including a rotatable handle having a cylindrical rod defining an axis of rotation of the handle. The rod has a recessed portion and an opposite arcuate portion defined by a circumference of the rod. The chisel is securable in and removable from the tool holder. The chisel has a longitudinal groove that is substantially parallel with the longitudinal axis. When the chisel is secured in the tool holder, the chisel is permitted to axially reciprocate within the tool holder in response to receiving repeated axial impacts from the striker. The handle is moveable between a first position, in which the arcuate portion is received in the groove and the chisel is secured in the tool holder, and a second position, in which the arcuate portion is removed from the groove, the recessed portion is in facing relationship with the groove, and the chisel is removable from the tool holder. The arcuate portion defines an angle of 110 degrees or less along the circumference of the rod with respect to the axis of rotation of the handle.

The present invention provides, in yet another aspect, a percussion tool for use with a chisel. The percussion tool comprises a housing including a cylinder portion and a tool holder coupled to the cylinder portion for holding the chisel. The percussion tool further comprises a percussion mechanism including a striker supported for reciprocation in the cylinder portion, the percussion mechanism configured to impart repeated axial impacts to the chisel via the striker. The percussion tool also comprises a flange between the cylinder portion and the tool holder, wherein movement of the chisel within the tool holder toward the percussion mechanism is stopped by the flange.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
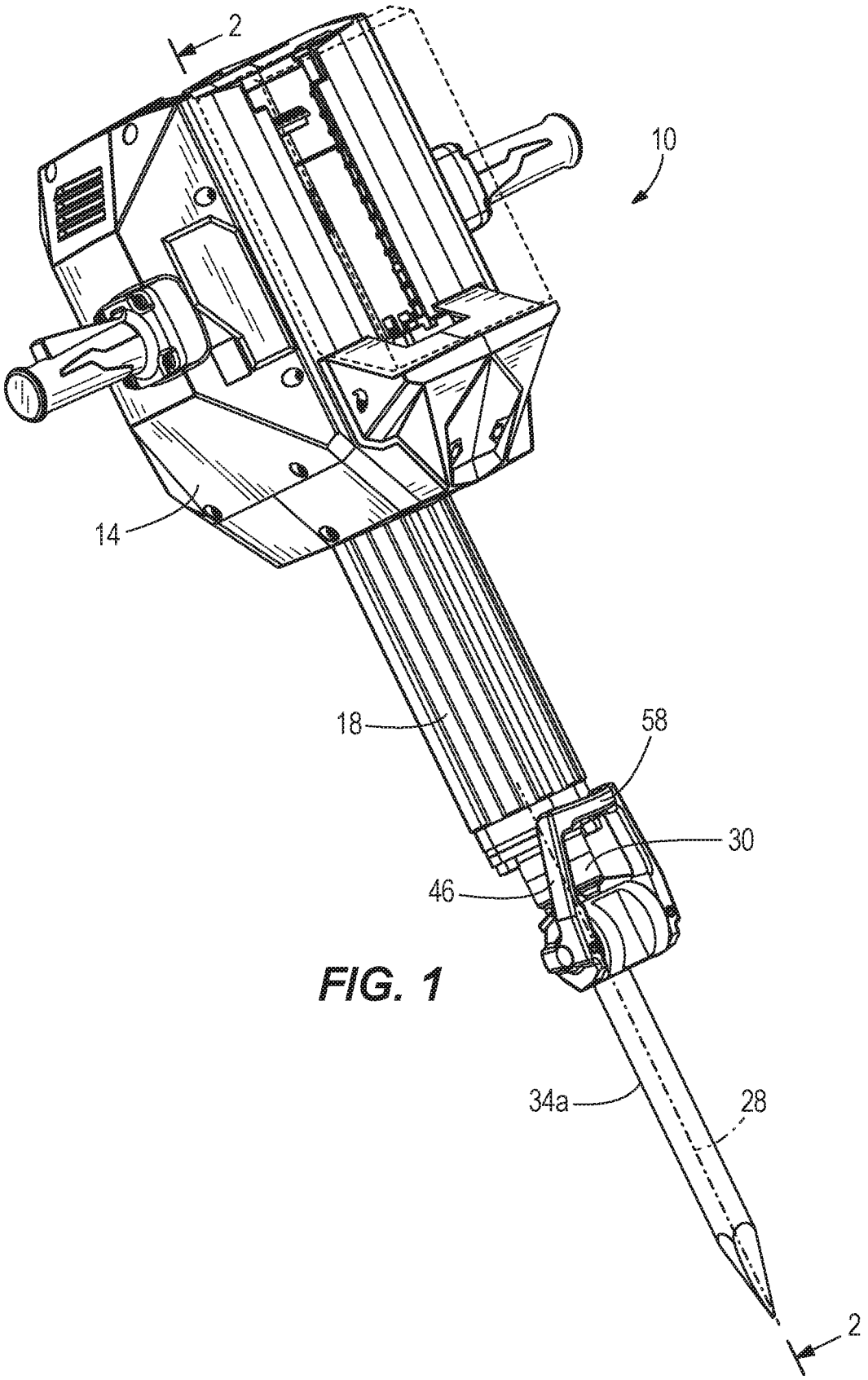
FIG. 1 is a perspective view of a percussion tool in accordance with an embodiment of the invention.
Figure 2:
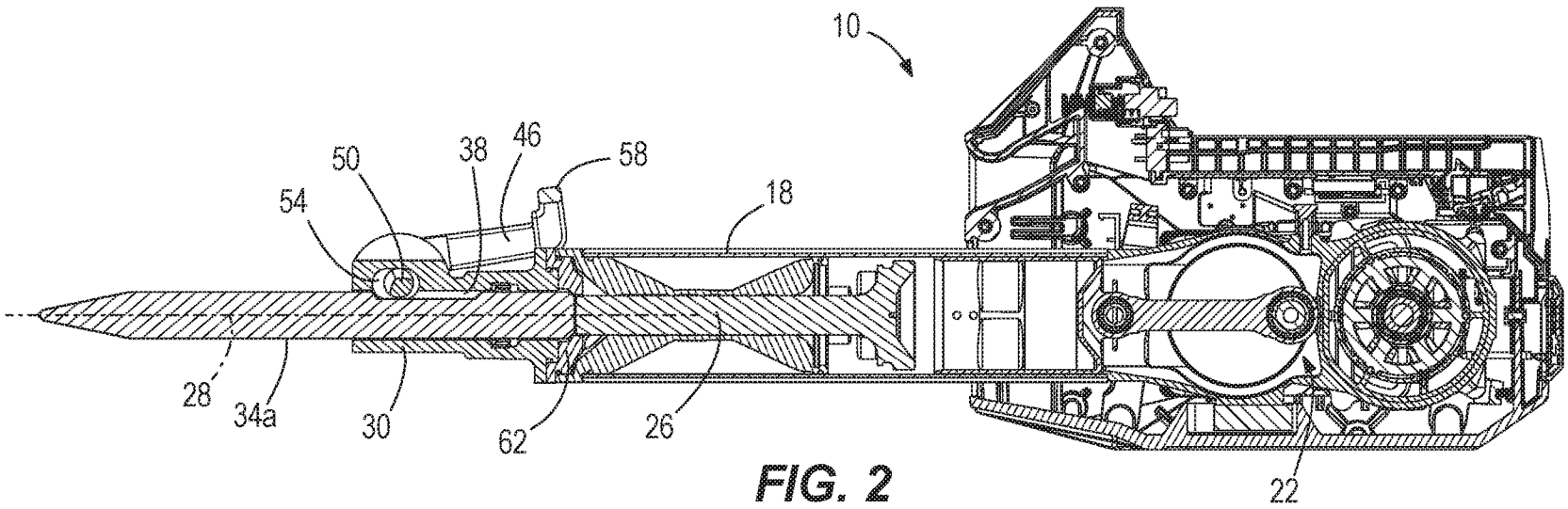
FIG. 2 is a cross-sectional view of the percussion tool of FIG. 1.

With reference to FIGS. 1 and 2, a percussion tool 10, such as a breaker, includes a housing 14 having a cylinder portion 18. A percussion mechanism 22 is disposed in the housing 10 and can be any suitable percussion mechanism, including but not limited to pneumatic, hydraulic, motor-driven, or electromagnetic. The percussion mechanism 22 includes a striker 26 supported for reciprocation along a longitudinal axis 28 in the cylinder portion 18.

Figure 3:
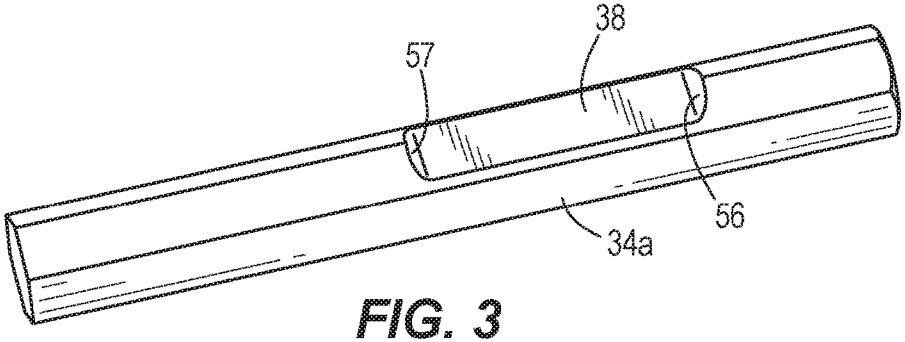
FIG. 3 is a perspective view of a chisel for use with the percussion tool of FIG. 1.
Figure 4:
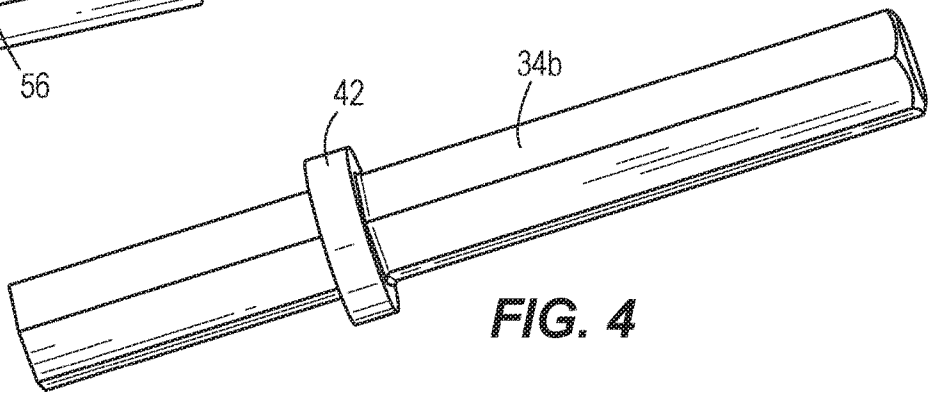
FIG. 4 is a perspective view of a different chisel for use with the percussion tool of FIG. 1.
Figure 5:
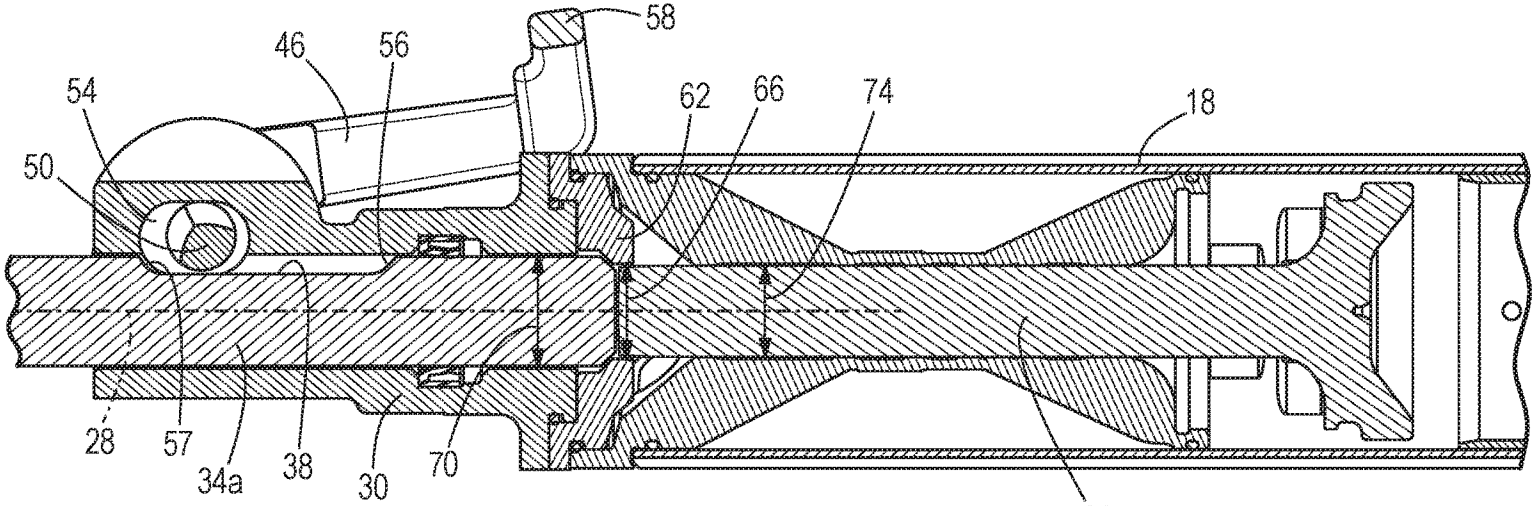
FIG. 5 is a cross-sectional view of portion of the percussion tool of FIG. 1 with a portion of the chisel of FIG. 3 inserted into a tool holder of the percussion tool.

A tool holder 30 for holding a chisel 34*a*, 34*b* is coupled to the cylinder portion 18. As will be explained in further detail below, the tool holder 30 is adapted to hold a variety of chisels. For example, the tool holder 30 is adapted to hold a chisel 34*a* with a radially inward-extending longitudinal groove 38 as shown in FIG. 3. The groove 38 is parallel with the longitudinal axis 28 when the chisel 34*a* is received in the tool holder 30. The tool holder 30 is also adapted to hold a chisel 34*b* that has a radially outward-extending flange 42 instead of a longitudinal groove, as shown in FIG. 4. The percussion mechanism 22 is configured to impart repeated axial impacts to the chisel 34*a*, 34*b* via the striker 26, so that a breaking operation or chiseling operation may be performed on a workpiece or surface.

Figure 6:
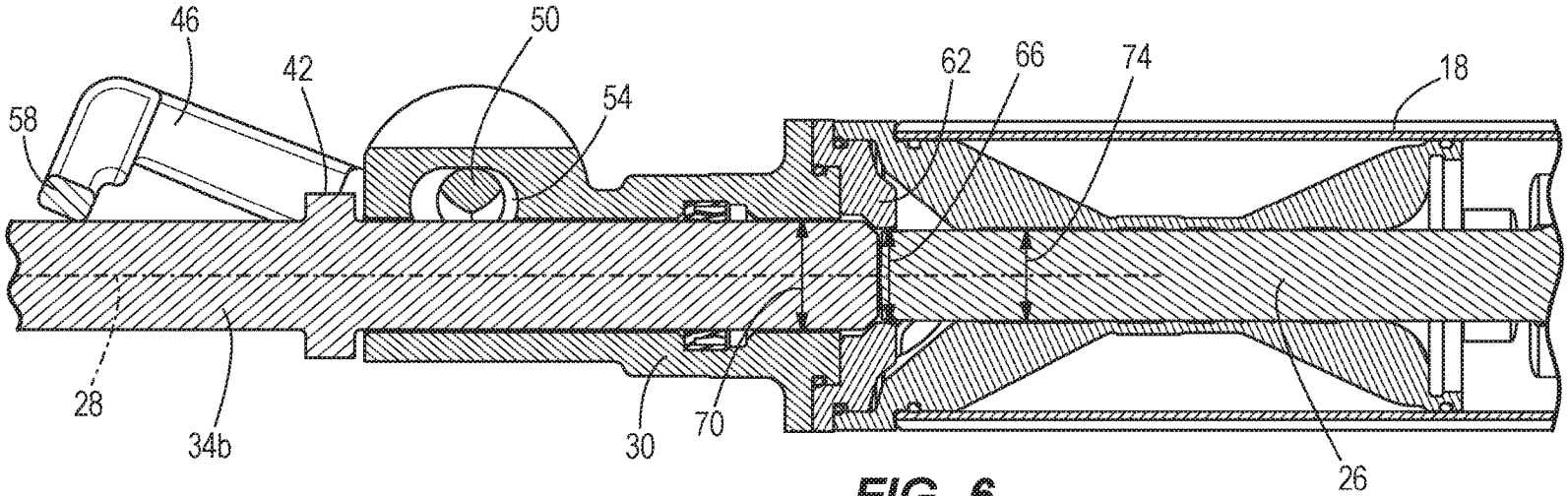
FIG. 6 is a cross-sectional view of a portion of the percussion tool of FIG. 1 with a portion of the chisel of FIG. 4 inserted into the tool holder of the percussion tool.
Figure 7:
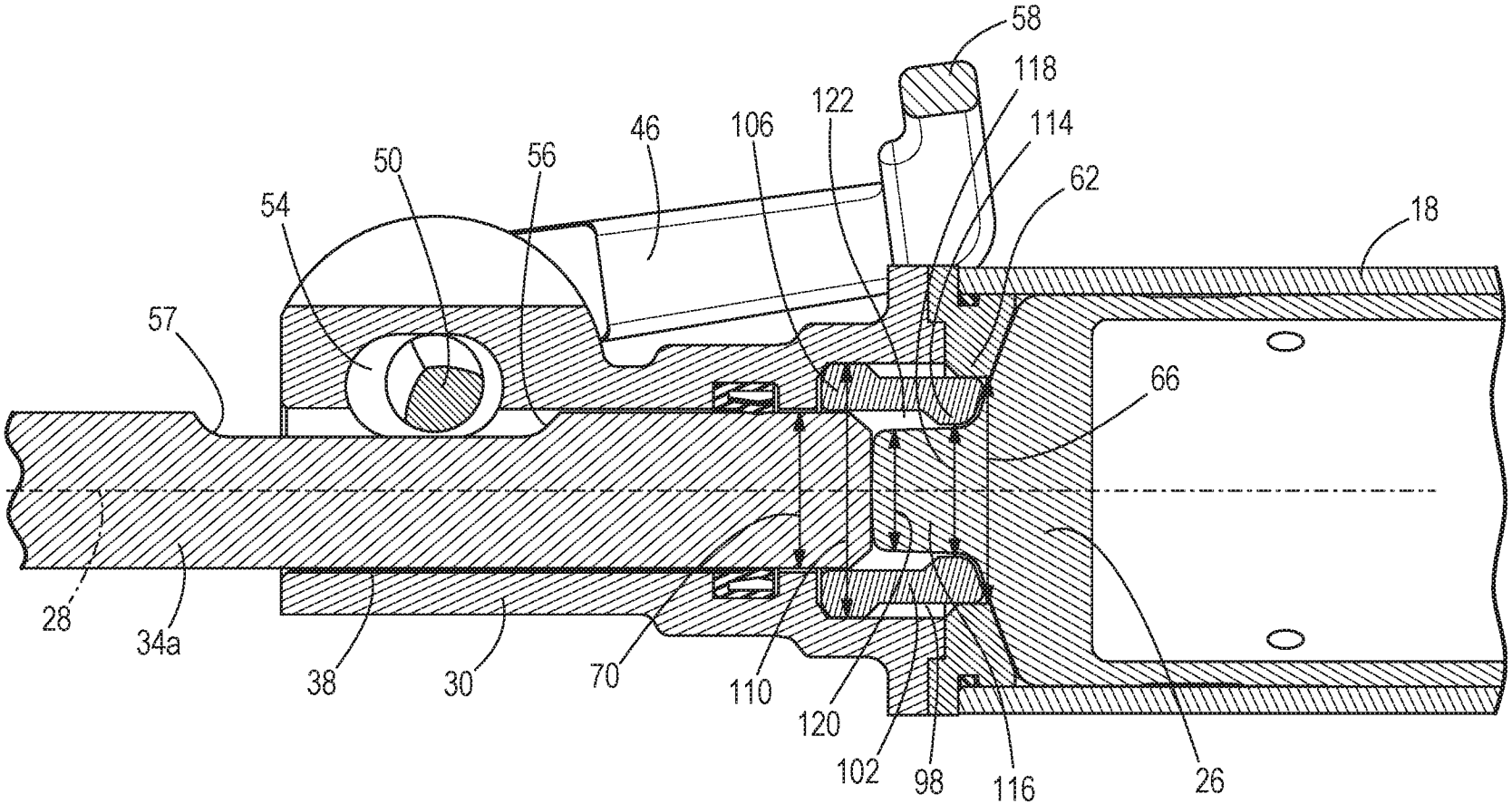
FIG. 7 is a cross-sectional view of a portion of a percussion tool in accordance with yet another embodiment of the invention, illustrating a portion of the chisel of FIG. 3 inserted into a tool holder of the percussion tool.
Figure 8:
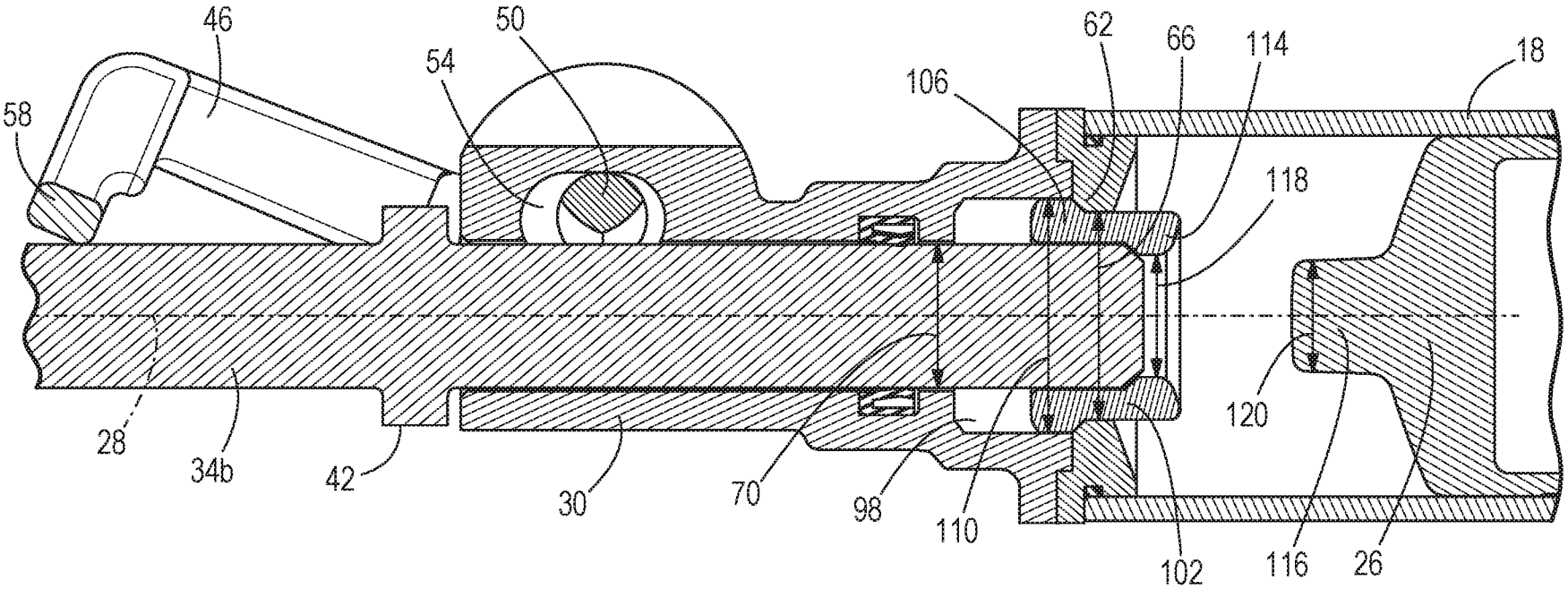
FIG. 8 is a cross-sectional view of a portion of the percussion tool of FIG. 7 with a portion of the chisel of FIG. 4 inserted into the tool holder of the percussion tool.

The tool holder 30 includes a rotatable handle 46 that can rotate between a first position shown in FIGS. 1, 2, 5 and 7, and a second position shown in FIGS. 6 and 8. The handle 46 includes an eccentric pin 50 rotatable therewith within a lateral recess 54 of the tool holder 30. If an operator elects to use chisel 34*a* with the percussion tool 10, rotation of the handle 46 to the first position causes the eccentric pin 50 to move radially inward within the recess 54, thereby engaging the longitudinal groove 38. Thus, if the operator tips the percussion tool 10 in such a manner that the chisel 34*a* might be caused to fall out of the tool holder 30, the eccentric pin 50 will contact a rear end 56 of the longitudinal groove 38 to prevent the chisel 34*a* from falling out. During operation of the percussion tool 10, as the striker 26 imparts axial blows to the chisel 34*a* along the longitudinal axis 28, the chisel 34*a* reciprocates within the tool holder 30 between forward and rearward positions where the eccentric pin 50 is maintained between the rear end 56 of the longitudinal groove and an opposite front end 57 of the longitudinal groove 38.

The handle 46 also includes a finger 58. If an operator elects to use chisel 34*b* with the percussion tool 10, the handle 46 is rotated to the second positon in which the finger 58 abuts the chisel 34*b*. As shown in FIGS. 6 and 8, rotation of the handle 46 to the second position also causes the eccentric pin 50 to move radially outward in the recess 54, so as to avoid interfering with chisel 34*b* within the tool holder 30, because chisel 34*b* does not have a longitudinal groove. Thus, if the operator tips the percussion tool 10 in such a manner that the chisel 34*b* might be caused to fall out of the tool holder 30, the finger 58 will contact the radially outward-extending flange 42 and prevent the chisel 34*b* from falling out.

A radially inward-extending flange 62 with an inner diameter 66 is located between the cylinder portion 18 and the tool holder 30. In a first embodiment of the invention shown in FIGS. 5 and 6, the inner diameter 66 of the flange 62 is less than an outer diameter 70 of either of the chisels 34*a*, 34*b*, and greater than an outer diameter 74 of the striker 26. Thus, when an operator inserts either of the chisels 34*a*, 34*b* into the tool holder 30, movement of the chisels 34*a*, 34*b* within the tool holder 30 toward the percussion mechanism 22 is stopped in response to the chisels 34*a*, 34*b* abutting the flange 62 (as shown in each of FIGS. 5 and 6).

In another embodiment of a percussion tool shown in FIGS. 7 and 8, with like features being identified with like reference numerals, the tool holder 30 includes a recess 98 to accommodate an axially moveable sleeve 102. The sleeve 102 has a first end 106 with a first end outer diameter 110 that is greater than the inner diameter 66 of the flange 62. The sleeve 102 has an opposite second end 114 with a second end inner diameter 118 that is less than the outer diameter 70 of each of the chisels 34*a*, 34*b*. A striking end 116 of the striker 26 has an outer diameter 120 that is nominally less than the inner diameter 118 of the second end 114 of the sleeve 102, so that the striking end 116 may pass through the sleeve 102 and strike the chisels 34*a*, 34*b*. The chisels 34*a*, 34*b* axially move within a hollow portion 122 of the sleeve 102. Thus, when an operator inserts either of the chisels 34*a*, 34*b* into the tool holder 30, movement of the chisels 34*a*, 34*b* within the tool holder 30 toward the percussion mechanism 22 is stopped in response to the chisels 34*a*, 34*b* abutting the second end 114 of the sleeve 102, and the first end 106 of the sleeve 102 abutting the flange 62 (as shown in FIG. 8).

The flange 62 limits the distance the chisels 34*a*, 34*b* can be inserted into the tool holder 30, thereby preventing damage to the percussion mechanism 22 and allowing the point of impact between the striker 26 and the chisels 34*a*, 34*b* to remain consistent. Also, regardless of which of the chisels 34*a*, 34*b* an operator selects, the same percussion tool 10 may be used because the tool holder 30 is adapted to hold a variety of chisels.

Figure 10:
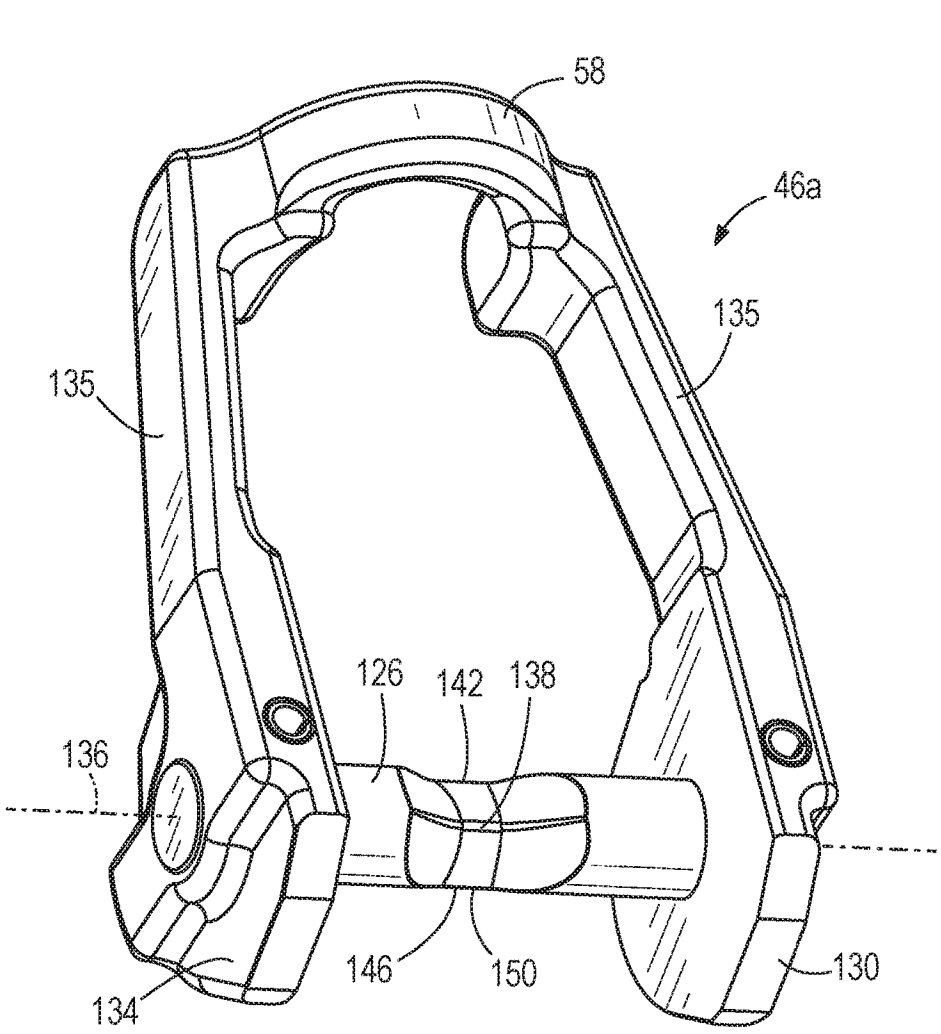
FIG. 10 is a bottom perspective view of the handle of FIG. 9.
Figure 11:
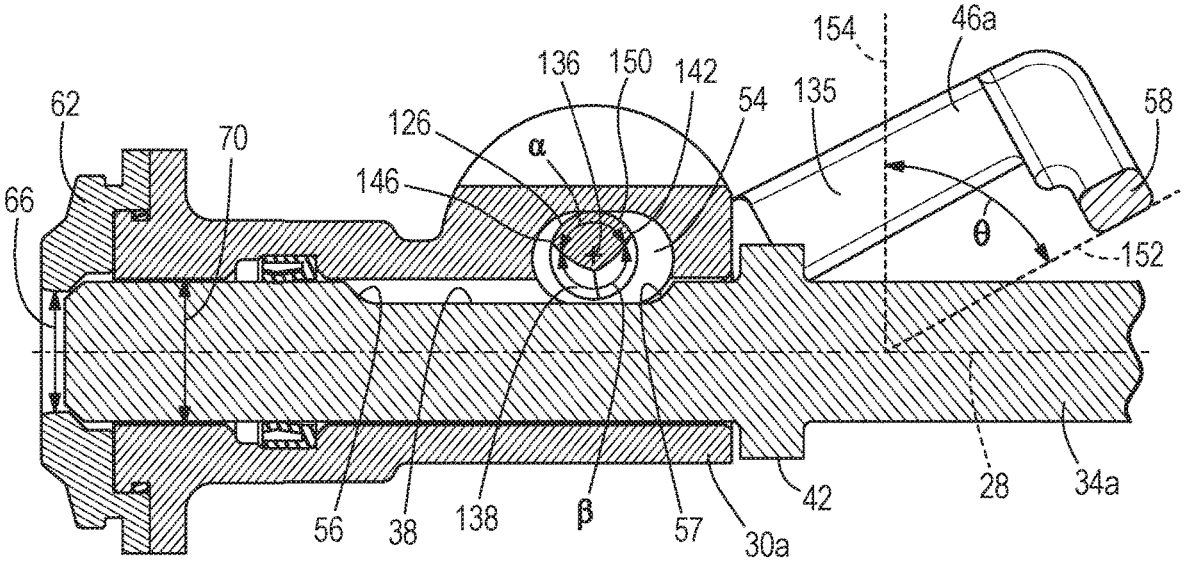
FIG. 11 is a cross-sectional view of another embodiment of a tool holder including the handle of FIG. 9, with portions removed.
Figure 12:
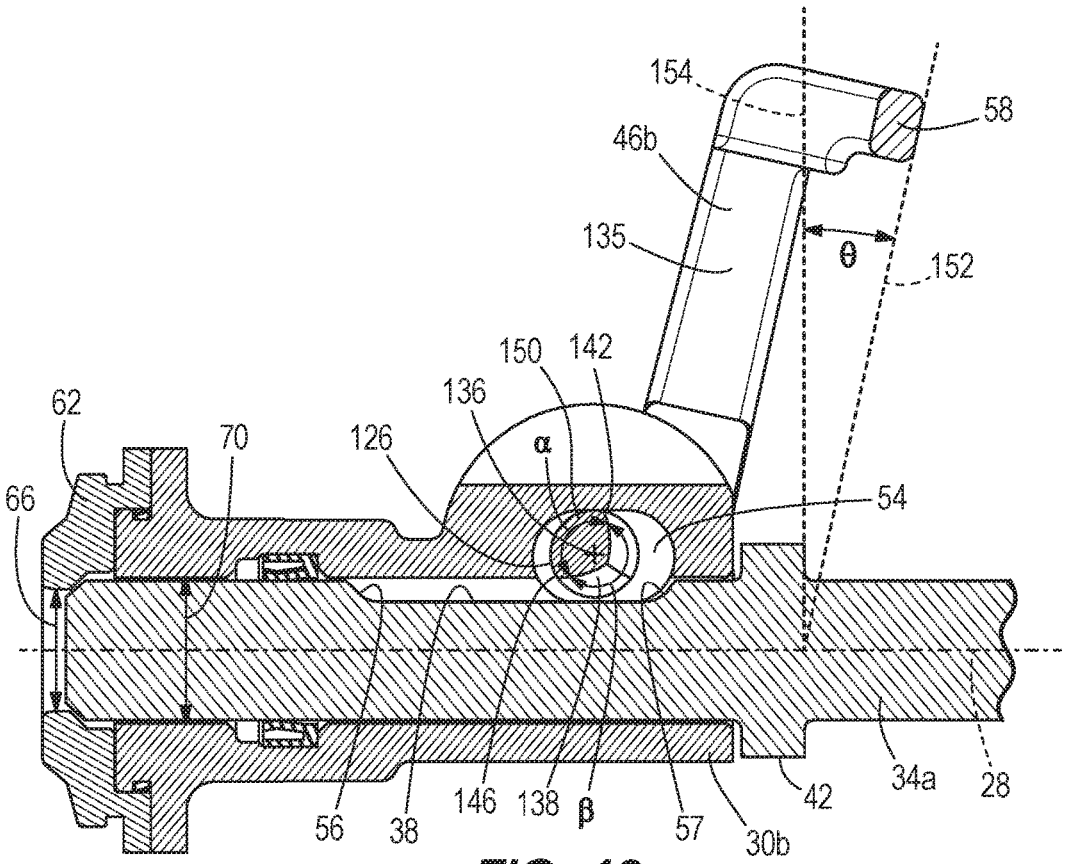
FIG. 12 is a cross-sectional view of another embodiment of a tool holder for use with the percussion tool of FIG. 1.

FIG. 11 illustrates another embodiment of a tool holder 30*a* for use with the breaker 10 of FIG. 1, with like components shown with like reference numerals. The tool holder 30*a* includes a handle 46*a* having a rod 126 extending between opposite ends 130, 134 of the handle 46*a* (see also FIGS. 9 and 10), two legs 135 respectively extending from the opposite ends 130, 134, and the finger 58 extending between the legs 135 and in a direction approximately perpendicular to the legs 135. The rod 126 extends through the recess 54 of the tool holder 30*a* and defines an axis of rotation 136 about which the handle 46*a* rotates with respect to the tool holder 30*a*. The rod 126 is cylindrical and has a recessed portion 138 defined between two edges 142, 146 on the circumference of the rod 126. Opposite the recess 138, an arcuate portion 150 is defined between the two edges 142, 146 along the circumference of the rod 126. As shown in FIG. 12, with respect to the axis of rotation 136, the arcuate portion 150 defines an angle $\alpha$ that is slightly less than 180 degrees about the circumference of the rod 126. Correspondingly, the recess 138 defines an angle $\beta$ that is slightly more than 180 degrees.

If an operator elects to use chisel 34*a* with the tool holder 30*a*, rotation of the handle 46*a* to the first position causes rod 126 to rotate such that the arcuate portion 142 contacts the chisel 34*a* within the longitudinal groove 38. Thus, if the operator tips the percussion tool 10 in such a manner that the chisel 34*a* might be caused to fall out of the tool holder 30*a*, the arcuate portion 150 will contact the rear end 56 of the longitudinal groove 38 to prevent the chisel 34*a* from falling out. During operation of the percussion tool 10, as the striker 26 imparts axial blows to the chisel 34*a* along the longitudinal axis 28, the chisel 34*a* reciprocates within the tool holder 30*a* between forward and rearward positions where the arcuate portion 150 is maintained between the rear end 56 of the longitudinal groove 38 and the front end 57 of the longitudinal groove 38.

Figure 9:
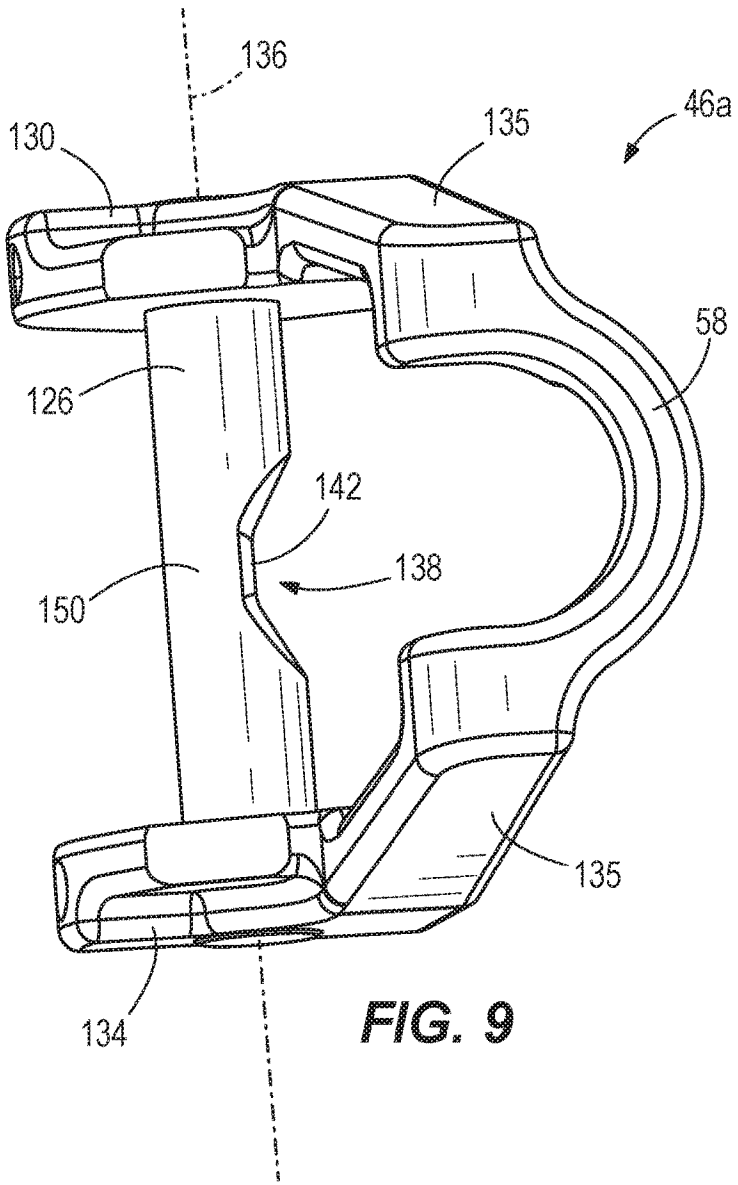
FIG. 9 is a top perspective view of another embodiment of a handle of a tool holder for use with the percussion tool of FIG. 1.

To release the chisel 34*a*, the operator must rotate the handle 46*a* from a first position (having an orientation relative to axis 28 similar to that shown in FIGS. 1 and 2) in which the arcuate portion 150 is located at least partially within the groove 38 of the chisel 34*a* to a second position shown in FIG. 11. Rotation of the handle 46*a* to the second position causes the rod 126 to rotate, thus rotating the arcuate portion 150 away from the longitudinal groove 38 and removing the arcuate portion 150 from the longitudinal groove 38 of the chisel 34*a*, and instead placing the recessed portion 138 in facing relationship with the longitudinal groove 38, thus allowing chisel 34*a* to be removed. As shown in FIG. 11, an angle θ is defined between a first reference plane 152 defined by handle 46*a* and a second reference plane 154 that is perpendicular to the longitudinal axis 28. In the embodiment of FIGS. 9-11, the angle θ is approximately 70 degrees. In the embodiment illustrated in FIG. 11, the first reference plane 152 is defined as tangent to the finger 58. In other embodiments, the first reference plane 152 could be defined as extending along the legs 135, and the second reference plane 154 would be shifted left, as viewed in FIG. 11. Regardless of where the reference plane 152 is defined on the handle 46*a*, if the handle 46*a* is rotated to a position intermediate the first and second positions, the first reference plane 152 would be co-planar with the second reference plane 154.

FIG. 12 illustrates another embodiment of a tool holder 30*b* for use with the breaker 10 of FIG. 1, with like components shown with like reference numerals. The tool holder 30*b* includes a handle 46*b* that is otherwise identical to the handle 46*a* except that the angle α defined by the arcuate portion 150 is approximately 110 degrees about the circumference of the rod 126. Thus, the recessed portion 138 defines an angle β that is approximately 250 degrees. To release the chisel 34*a*, the operator must rotate the handle 46*b* from a first position (having an orientation relative to axis 28 similar to that shown in FIGS. 1 and 2) in which the arcuate portion 150 is located at least partially within the groove 38 of the chisel 34*a* to a second position shown in FIG. 12. In this embodiment of the tool holder 30*b*, the angle θ defined between the finger 58 of handle 46*b* and the plane 154 is approximately 10 degrees. Because the arc length of the arcuate portion 142 has been reduced to approximately 110 degrees in the embodiment of FIG. 12, the operator does not need to rotate the handle 46*b* as far as in the embodiment of the tool holder 30*a* shown in FIG. 11 to release the chisel 34*a* (70 degrees beyond the second reference plane 154 with the tool holder 30*a* versus 10 degrees beyond the second reference plane 154 with the tool holder 30*b*). Such an arrangement makes it faster and easier for the operator to change the chisels 34*a*, 34*b* used in the tool holder 30*b*. In the embodiment illustrated in FIG. 12, the first reference plane 152 is defined as tangent to the finger 58. In other embodiments, the first reference plane 152 could be defined as extending along the legs 135, and the second reference plane 154 would be shifted left, as viewed in FIG. 12. Regardless of where the reference plane 152 is defined on the handle 46*b*, if the handle 46*b* were rotated to a position intermediate the first and second positions, the first reference plane 152 would be co-planar with the second reference plane 154.

Various features of the invention are set forth in the following claims.

What is claimed is:

1. A percussion tool for performing a chiseling operation on a workpiece with a chisel, the percussion tool comprising:

a housing;

an electric motor positioned within the housing;

a percussion mechanism driven by the motor and including a striker supported for reciprocation relative to the housing along a longitudinal axis;

a cylinder portion in which the striker is supported for reciprocation;

a tool holder coupled to the housing and including a rotatable handle having a rod that rotates with the handle within the tool holder, the chisel being securable in and removable from the tool holder, the chisel having a longitudinal groove that is substantially parallel with the longitudinal axis;

a flange between the cylinder portion and the tool holder; and a sleeve slidably supported by at least one of the tool holder or the flange, wherein when the chisel is secured in the tool holder, the chisel is permitted to axially reciprocate within the tool holder in response to receiving repeated axial impacts from the striker, wherein the handle is moveable between a first position, in which the rod is received in the groove and the chisel is secured in the tool holder, and a second position, in which the rod is removed from the groove and the chisel is removable from the tool holder, wherein when the handle is in the second position, an acute angle is defined between a first reference plane defined by the handle and a second reference plane that is perpendicular to the longitudinal axis, and wherein the acute angle is 10 degrees or less, wherein the sleeve has a first end with a first end outer diameter that is greater than an inner diameter of the flange, wherein the sleeve has a second end with a second end inner diameter that is less than an outer diameter of the chisel, and wherein movement of the chisel within the tool holder toward the percussion mechanism is stopped in response to the chisel abutting the second end of the sleeve and the first end of the sleeve abutting the flange.

2. The percussion tool of claim 1, wherein the rod has a recessed portion and an opposite arcuate portion defined by a circumference of the rod, and wherein in the first position, the arcuate portion is received in the groove, and in the second position, the arcuate portion is removed from the groove and the recessed portion is in facing relationship with the groove.

3. The percussion tool of claim 2, wherein the rod defines an axis of rotation of the handle, wherein the arcuate portion defines an angle along the circumference of the rod with respect to the axis of rotation of the handle, and wherein the angle is 180 degrees or less.

4. The percussion tool of claim 3, wherein the angle is 110 degrees or less.

5. The percussion tool of claim 1, wherein the striker has an impact portion with an impact portion outer diameter, and wherein the second end inner diameter is greater than the impact portion outer diameter, such that the impact portion is configured to pass through the second end of the sleeve.

6. A percussion tool for performing a chiseling operation on a workpiece with a chisel, the percussion tool comprising:

a housing;

an electric motor positioned within the housing;

a percussion mechanism driven by the motor and including a striker supported for reciprocation relative to the housing along a longitudinal axis;

a cylinder portion in which the striker is supported for reciprocation;

a tool holder coupled to the housing and including a rotatable handle having a cylindrical rod defining an axis of rotation of the handle, the rod having a recessed portion and an opposite arcuate portion defined by a circumference of the rod;

a flange between the cylinder portion and the tool holder; and a sleeve slidably supported by at least one of the tool holder or the flange, wherein the chisel is securable in and removable from the tool holder, the chisel having a longitudinal groove that is substantially parallel with the longitudinal axis, wherein when the chisel is secured in the tool holder, the chisel is permitted to axially reciprocate within the tool holder in response to receiving repeated axial impacts from the striker, wherein the handle is moveable between a first position, in which the arcuate portion is received in the groove and the chisel is secured in the tool holder, and a second position, in which the arcuate portion is removed from the groove, the recessed portion is in facing relationship with the groove, and the chisel is removable from the tool holder, wherein the arcuate portion defines an angle of 110 degrees or less along the circumference of the rod with respect to the axis of rotation of the handle, wherein the sleeve has a first end with a first end outer diameter that is greater than an inner diameter of the flange, wherein the sleeve has a second end with a second end inner diameter that is less than an outer diameter of the chisel, and wherein movement of the chisel within the tool holder toward the percussion mechanism is stopped in response to the chisel abutting the second end of the sleeve and the first end of the sleeve abutting the flange.

7. The percussion tool of claim 6, wherein when the handle is in the second position, an acute angle is defined between a first reference plane defined by the handle and a second reference plane that is perpendicular to the longitudinal axis, and wherein the acute angle is 70 degrees or less.

8. The percussion tool of claim 7, wherein when the acute angle is 10 degrees or less.

9. A percussion tool for performing a chiseling operation on a workpiece with a chisel, the percussion tool comprising:

a housing including a cylinder portion;

a tool holder coupled to the cylinder portion for holding the chisel;

a percussion mechanism including a striker supported for reciprocation in the cylinder portion, the percussion mechanism configured to impart repeated axial impacts to the chisel with the striker;

a flange between the cylinder portion and the tool holder; and a sleeve slidably supported by at least one of the tool holder or the flange, wherein the sleeve has a first end with a first end outer diameter that is greater than an inner diameter of the flange, wherein the sleeve has a second end with a second end inner diameter that is less than an outer diameter of the chisel, and wherein movement of the chisel within the tool holder toward the percussion mechanism is stopped in response to the chisel abutting the second end of the sleeve and the first end of the sleeve abutting the flange.

10. The percussion tool of claim 9, wherein the striker has an impact portion with an impact portion outer diameter, and wherein the second end inner diameter is greater than the impact portion outer diameter, such that the impact portion is configured to pass through the second end of the sleeve.

11. The percussion tool of claim 10, wherein the first end of the sleeve has a first end internal diameter that is greater than the outer diameter of the chisel, such that the chisel is configured to pass through the first end of the sleeve.

12. The percussion tool of claim 11, wherein the second end of the sleeve has an outer diameter that is less than the inner diameter of the flange, such that the second end of the sleeve is configured to pass through the flange.

* * * * *